United States Patent [19]

Ottaviano

[11] Patent Number: 4,619,635

[45] Date of Patent: Oct. 28, 1986

[54] AUTOMATIC FEED CIRCUIT FOR DUNNAGE CONVERTER

[75] Inventor: Gary W. Ottaviano, Bedford Heights, Ohio

[73] Assignee: Ranpak Corp., Willoughby, Ohio

[21] Appl. No.: 794,558

[22] Filed: Nov. 4, 1985

[51] Int. Cl.[4] ..... B31B 1/00

[52] U.S. Cl. ..... 493/36

[58] Field of Search ..... 443/36; 270/69, 83, 270/80

[56] References Cited

U.S. PATENT DOCUMENTS

| | | | |
|---|---|---|---|
| 3,266,794 | 8/1966 | Weir | 493/36 |
| 3,899,166 | 8/1975 | Behn | 493/36 |
| 4,061,326 | 12/1977 | Proudman | 493/36 |

*Primary Examiner*—Leon Gilden

*Attorney, Agent, or Firm*—Baldwin, Egan & Fetzer

[57] ABSTRACT

A dunnage converter mechanism for producing relatively low density pad-like cushioning dunnage product from flexible sheet-like stock material in roll form. The converter includes means for pulling the sheet-like stock material from a supply roll thereof into the mechanism while causing inward rolling of the lateral edges of the sheet-like stock material, resulting in a pad-like cushioning product emitted from the machine, with the product having lateral relatively resilient pillow-like portions and a central connecting section holding the pillow-like portions together in generally side-by-side attached relation. A settable control means is provided in an associated control circuit coupled to the electric drive motor for the converter mechanism, for selectively providing for programming the motor for actuation thereof during selected predetermined periods of time, whereby the pad-like dunnage product can be produced by the mechanism for a selected period of time of a plurality of time periods without any further action being needed on the part of a machine operator, after which the mechanism automatically shuts down production of the cushioning product. The settable control includes a selector module for selecting one of a plurality of time periods (e.g. seconds, minutes or hours) together with means for selecting ranges of said selected one time period, so that various lengths or runs of the produced cushioning product can be automatically provided.

14 Claims, 6 Drawing Figures

AUTOMATIC FEED CIRCUIT FOR DUNNAGE CONVERTER

This invention relates in general to mechanism for producing a packaging material or cushioning dunnage as it is known in the art, and more particularly to a dunnage producing mechanism for the production of a strip of resilient pad-like dunnage product from sheet-like stock material disposed in multi-ply stock roll form, with the sheet-like stock material being pulled into the mechanism from the roll by means of an electric motor driven, connecting section of the mechanism, and together with a settable control means provided in circuit with the motor, providing for selectively programming the motor for actuation thereof for a selected period of time of a predetermined plurality of time periods, whereby the pad-like product can be automatically produced by said mechanism for a selected time period without the need of any further action on the part of a machine operator, thus freeing the operator to accomplish other tasks while the mechanism is producing the selected length strip of cushioning dunnage product.

BACKGROUND OF THE INVENTION

Dunnage producing mechanism for producing resilient pad-like cushioning dunnage product in strip form, having lateral pillow-like portions and a central connected or joined section running generally lengthwise of the strip of cushioning dunnage product, are known in the art. U.S. Pat. No. 4,026,198 to Ottaviano dated May 31, 1977 and entitled Cushioning Dunnage Mechanism, Transfer Cart Therefor, and Method, discloses a cushioning dunnage producing machine or mechanism of the general type to which the present invention may be applied.

This type machine is adapted to take sheets of stock material from a multi-ply stock roll and pull them into the machine while rolling the lateral edges of the sheet-like material into generally rolled form, and then connecting the rolled sections together along the central portion of the pad-like product, and then emitting the strip of cushioning dunnage product from the machine, with the product comprising relatively resilient laterally spaced pillow-like sections or portions and a centrally oriented connecting section running generally lengthwise of the strip of product.

The connecting mechanism in this type of prior art machine is a pair of coacting vertically arranged gear-like members, which coin the adjacent confronting edges of the lateral pillow-like sections along the generally central section of the rolled edge stock material strip, and thus connect together the lateral pillow-like sections, resulting in the pad-like dunnage product.

There are numerous other prior art patents disclosing dunnage producing mechanisms and methods for producing a resilient pad-like cushioning dunnage product of a generally similar type to that of the present product; however, in all of these prior art mechanisms so far as applicant has been able to determine, the product is emitted from the machine by means of an operator control system which either includes an intermittent control where the operator can control the length of strip of dunnage product emitted from the machine by a spring loaded hand control button switch or a spring loaded foot control button switch which are actuated so long as pressure is applied thereto by the workman, and which in the case of the foot switch frees the hands of the operator, or the machine has a "maintained" control switch arrangement that can be switched on and in such condition will maintain the machine running and emitting a continuous strip of pad-like cushioning dunnage product, until the maintained control switch is manually shut off.

SUMMARY OF THE INVENTION

The present invention provides a dunnage producing mechanism that enables the machine operator to selectively choose the length of strip of cushioning dunnage product that is to be produced by the machine by programming the machine, and then the machine will automatically produce the dunnage product for a selected period of time and then will automatically shut down without the need of an operator monitoring the production of such selected length of strip product and without the need of the operator being at the machine to manually actuate the same to produce such selected length of produced pad-like cushioning product.

In other words, the dunnage producing mechanism of the present invention comprises a control circuit including a settable control means which enables the operator to selectively program the machine for actuation thereof for predetermined periods of time, whereby the dunnage product will be automatically produced by the mechanism for the selected period without any further action or overseeing on the part of a machine operator. Thus, the machine operator is able to perform other duties and move about, while the machine is producing a selected length of strip of product, and without the operator being continuously involved with the operation of the machine.

Accordingly, an object of the invention is to provide a novel mechanism for producing cushioning dunnage for use as packing material and the like.

Another object of the invention is to provide a mechanism of the latter type which utilizes a plurality of webs or sheets of stock material, such as paper disposed in roll form, and forming such webs into a pad-like cushioning dunnage product possessing lateral pillow-like portions and a central connecting portion running generally lengthwise of the strip of dunnage product, and wherein the mechanism is provided with settable control means adapted to selectively provide for programming the drive motor of the mechanism to actuate the same for selected predetermined periods of time whereby the pad-like cushioning dunnage product can be automatically produced by said mechanism for a selected period of time of a plurality of time periods, without further monitoring, controlling or overseeing on the part of the machine operator.

A still further object of the invention is to provide a mechanism of the latter described type which includes a connecting section in the mechanism for generally securely connecting the lateral resilient pillow-like portions of the product together along a central portion thereof running lengthwise of the strip of product, and wherein the connecting section is operative to pull the sheet-like stock material from the roll into the mechanism for the formation of the product and then to emit the produced product from the mechanism, and wherein the settable control means of the control circuit is coupled to the electric drive motor of the mechanism to thus provide for selectively programming of the motor for automatic actuation thereof for selected predetermined periods of time without further monitoring, controlling or overseeing on the part of the machine operator.

A still further object of the invention is to provide a mechanism of the latter type which includes powered cutter means thereon for selective actuation in the cutting of the strip of dunnage product produced by the machine into selected lengths, together with manual control means for causing actuation of the powered cutter means to initiate the cutting operation, and with means being provided in circuit with the settable control means and with the motor, for automatically interrupting the activation of the motor upon activation of such cutter control means, whereby the cutting operation on the dunnage product occurs when the produced product is stationary in the machine.

Other objects and advantages of the invention will be apparent from the following description taken in conjunction with the accompanying drawings wherein:

DESCRIPTION OF PREFERRED EMBODIMENT

Figure 1:
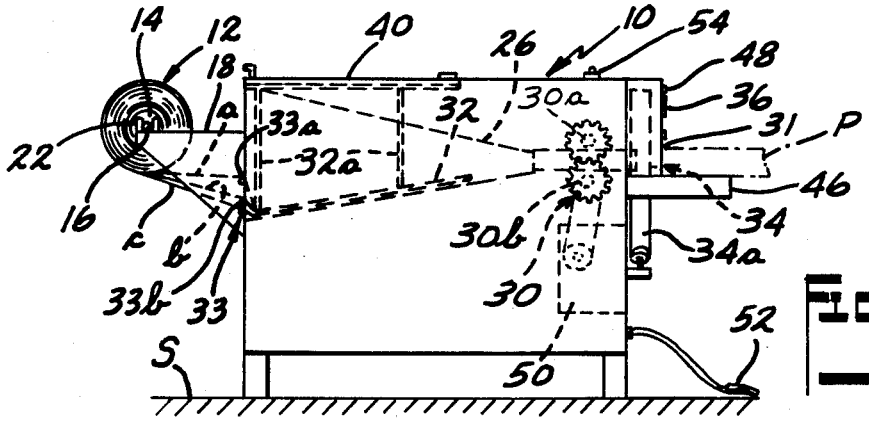
FIG. 1 is a generally diagrammatic side elevational view of a cushioning dunnage producing machine or mechanism which embodies the invention.
Figure 2:
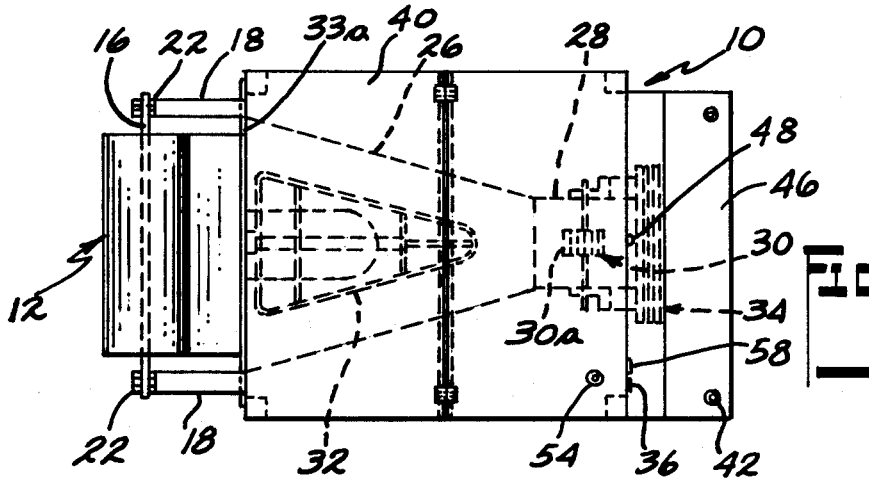
FIG. 2 is a top plan view of the machine of FIG. 1.
Figure 6:
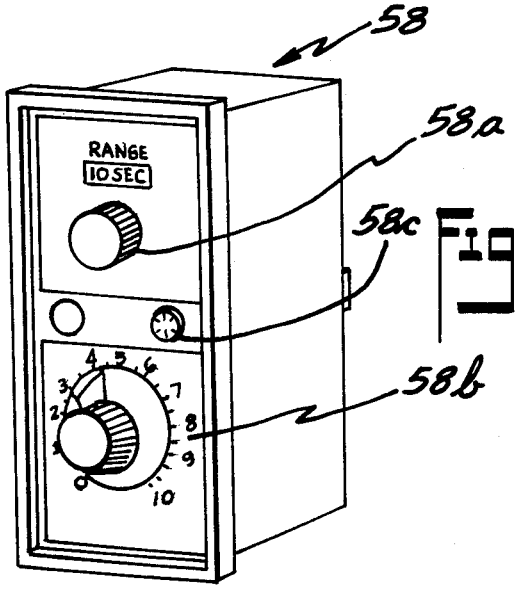
FIG. 6 is an enlarged front perspective view of a settable control module for use in the circuit of FIG. 5.
Figure 3:
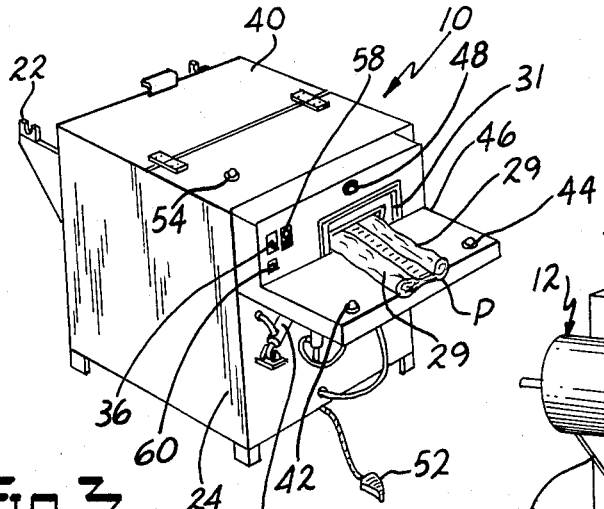
FIG. 3 is a perspective rear elevation of the machine of FIGS. 1 and 2 illustrating a strip of dunnage product being emitted from the machine.
Figure 4:
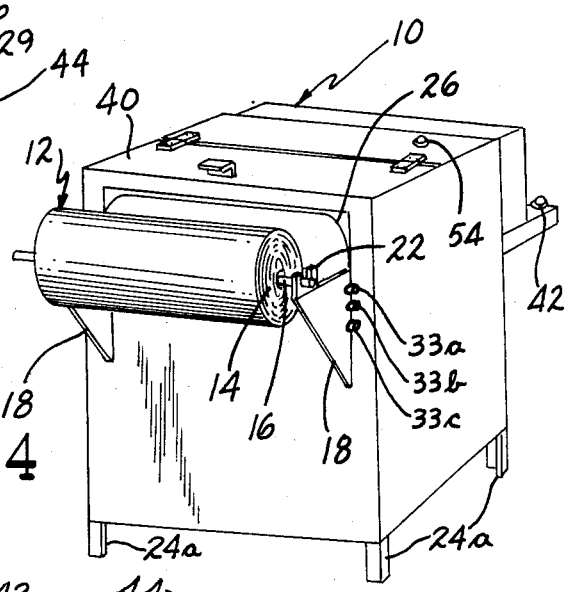
FIG. 4 is a perspective view of the machine of FIG. 3 taken from the opposite end or stock material entry end thereof.

Referring now again to the drawings and particularly to FIGS. 1–4 thereof, there is illustrated a dunnage producing machine or mechanism 10 which utilizes a single, multi-ply stock roll 12 of sheet-like stock material such as, for instance, 30 pound kraft paper sheet. In the embodiment of stock roll illustrated, the plies of the stock roll are illustrated as being of equal width and in the embodiment illustrated comprise three plies disposed in roll form for expeditious installation on the dunnage producing mechanism.

The stock roll 12 comprises, in the embodiment illustrated, a hollow core 14 of generally cylindrical configuration on which the three superimposed webs or sheets of paper stock material are wound. The stock roll is adapted to be mounted on a supporting rod 16 extending through the core 14 for rotation of the stock roll 12 relative to the support bracket structure 18, as the paper stock is drawn into the dunnage machine 10.

Open topped, upstanding, generally U-shape guides 22 are provided, in the embodiment illustrated, for generally loosely receiving the ends of the rod 16 and retaining the rod on the support structure 18 while providing for generally rapid replacement of a stock roll when necessary. One end of the rod extending through the stock roll is adapted to have an opening therethrough receiving a pin (not shown) projecting laterally of the rod for preventing or limiting rotation of the rod upon rotation of the roll about the rod. In other words, the roll of stock material preferably frictionally rotates relative to the rod 16 during pulling of the stock material into the dunnage producing mechanism, in the embodiment illustrated.

While in the embodiment illustrated, the stock roll is mounted directly on the dunnage producing mechanism, it will be understood that the roll of stock material could be mounted on a separate support and fed into the mechanism 10 in a manner known in the art.

The machine 10 in the embodiment illustrated, comprises a framework 24 including leg portions **24*a* for supporting the framework 24 with respect to a supporting surface S (FIG. 1**).

The framework 24 in the embodiment illustrated, supports a longitudinally converging funnel-like member or chute 26 which chute forms a guide and support for the webs of stock material a, b and c as they are drawn off the stock roll and are passed to a longitudinally elongated crumpler section 28 of the dunnage producing machine. In the embodiment illustrated, the chute 26 and the crumpler section 28 may be provided as a integral unit.

As the sheets or webs of stock material are drawn off from the roll 12 of stock material, they are passed through the chute wherein the lateral edges of the sheets are caused to be rolled inwardly to form the pillow-like portions 29 (FIG. 3) of the produced dunnage product P, and the connecting mechanism 30 of the machine comprising meshed vertically arranged motor driven gear members **30*a*, 30*b*, secures the adjacent pillow-like portions together along the generally central portion of the pad-like product running lengthwise of the same, to form a pad-like dunnage product P which is adapted for use as cushioning packing and the like. Reference may had to aforementioned U.S. Pat. No. 4,026,198 which is incorporated herein by reference, for a more detailed disclosure of the structural arrangement of a suitable connecting mechanism which in addition to connecting the lateral pillow-like portions to one another, moves the sheets of stock material from the supply roll through the machine and which also operates to emit the produced pad-like product out the exit end 31** of the machine.

Pusher mechanism 32 in the embodiment illustrated comprises a tubular framework of generally triangular shape in plan (FIG. 2) and is supported in the chute 26 in relatively closely spaced relation to the bottom interior surface thereof by front and rear threaded rods **32*a*. Rods 32*a*** may be adjustable to provide for adjustment of the relative closeness of the pusher with respect to the confronting surface of the chute.

Mounted on the frame 24 downstream from the rotational mounting 22 of the stock roll 12 is a separating means 33 (FIG. 1). In the embodiment illustrated separating means 33 comprises a plurality of vertically spaced bar-like elements **33*a*, 33*b*, and 33*c* through which are adapted to pass the webs of stock material from the stock roll 12**.

The separator mechanism maintains the webs in separated condition prior to their being urged back into generally juxtaposed condition at the pusher mechanism 32, the latter being downstream from the preferably cylindrical separator rods.

A powered cutter mechanism 34 of conventional type and actuated, as for instance by means of a pneumatic motor unit 34*a* controlled by a solenoid valve 34*b* (FIG. 5) may be provided, for selectively severing or cutting the pad-like product being emitted from the machine, into selected lengths. Such cutter mechanism is operated manually, preferably by the hands of a workman actuating manual switches for controlling actuation of the cutter power unit 34*a*, as will be hereinafter described in greater detail.

Figure 5:
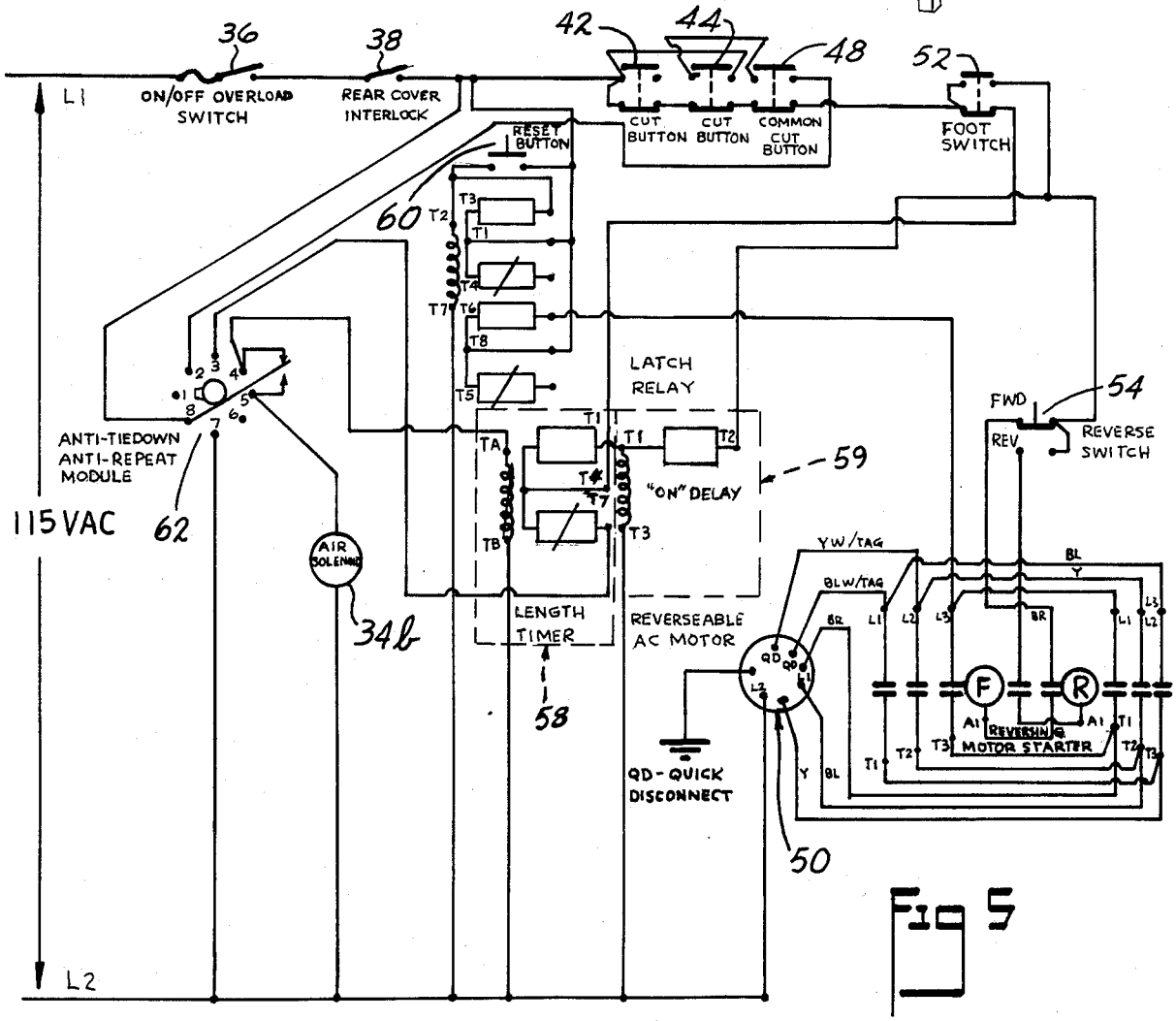
FIG. 5 is a schematic of the control circuit for the machine of FIGS. 1–4 and which includes a settable control module providing for programming of the drive motor for the machine for actuation thereof for a selected period of time of a plurality of time periods, whereby the pad-like dunnage product can be automatically produced by the machine for the selected period without further monitoring, control or overseeing on the part of a machine operator.

Referring now particularly to FIG. 5, there is shown schematically a control system for controlling operation of the dunnage producing mechanism. The system is adapted for being plugged into a conventional 115 volt A.C. source of electrical power, and includes manual on-off overload switch 36, and also preferably rear cover interlock switch 38, which ensures that the mechanism 10 is operable only if access cover 40 is in its "down" position, as illustrated.

Left and right manually actuated spring loaded cut button switches 42, 44 are provided on table portion 46 of the mechanism, together with common spring loaded cut button switch 48 located preferably generally centrally of the framework 24 at the exit end of the converter mechanism, for manual actuation of the aforementioned cutter device 34 by the operator. It will be seen that in order to actuate the solenoid valve 34*b* controlling the cutter motor unit 34*a*, both the common cut button switch 48 and one or the other of the cut button switches 42, 44 must be actuated, which supplies current to the solenoid valve 34*b* to cause actuation of the air cylinder 34*a*, and thus actuation of the cutter device, thereby accomplishing generally transverse severing of the produced dunnage product from the continuous strip thereof emitted from the machine. Having a cut botton switch on both sides of the machine facilitates operation of the converter by a workman from either side of the converter mechanism.

Actuation of any of the button switches 42, 44 or 48 disconnects the reversible electric drive motor 50 which drives the connecting means 30 of the converter mechanism, thus ensuring that the produced product will be stationary relative to the converter mechanism during the aforementioned severing operation.

In the embodiment illustrated, spring biased foot switch 52 is provided for furnishing a manual operator control for actuation of electric motor 50, and thus actuation of the converter mechanism. Actuation of the manual foot switch 52 by the machine operator causes energization of the drive motor 50, to cause the produced dunnage product to be emitted from the exit end of the converter mechanism. Release of the foot switch automatically disconnects the drive motor 50 from power, and causes the converter mechanism to stop emitting dunnage product if it is under manual control.

Motor 50 is preferably a reversible AC motor and includes manual reversing switch 54 (FIGS. 3 and 5) for providing for reverse actuation of the electric motor 50, whereby the strip of produced dunnage product can be reversed in its direction of movement, and moved in the direction of the supply roll 12. Such an arrangement is convenient in the event of a need to remove a "jam" in the converter mechanism in the production of the pad-like dunnage product.

Referring now particularly to FIGS. 5 and and 6, the control circuit illustrated includes a settable control module 58 which enables the machine operator to selectively program the drive motor 50 for actuation thereof for a selected one period of time of a predetermined plurality of periods of time, as provided by the control module 58, whereby the pad-like product will be automatically produced by the converter mechanism for the selected one period of time, without further monitoring, control or overseeing on the part of the machine operator.

Such control module 58 in the embodiment illustrated comprises a dial adjustable, length timer module which in the preferred embodiment has six settable time periods and more particularly periods of one second, ten seconds, one minute, ten minutes, one hour and ten hours. Such time periods are selected by turning the upper dial 58*a* to the selected time period (e.g. ten seconds) with the lower control dial 58*b* providing for varying the range of the selected time period within the increments indicated on the lower dial, thus controlling the period of time in which the timer module 58 will cause automatic energization of the drive motor 50 of the dunnage producing converter mechanism. For instance, for the aforementioned selected time period of ten seconds, rotation of lower dial 58*b* from the numerical setting 10 to the numerical setting 1 on the lower dial can change the selected time period from the selected maximum of ten seconds down to a one second period. The same holds true for the other selectable time periods whether it be minutes or hours, or one second time ranges.

A suitable timer module is one known as a 328A length timer produced by Automatic Timing and Controls Company of King of Prussia, Pa. 19406. The module may be provided with an indicator light 58*c* which is activated when the time relay 58 is set to "on" condition and which, at the end of the timing period selected, is adapted to blink rapidly until the timer module is reset, to indicate that the timing cycle controlled by the module 58 is completed. At the end of the selected timing period, the timing relay 58 will automatically drop out and the timer goes back to the "before start" condition.

Coupled to the timer module 58 is an on delay timer 59 which will delay energization of the motor 50 for a predetermined short period of time (approximately one second) after the module is activated (as by moving switch 36 to "on" position), in order to provide for giving the cutter 34 time to return to its home or inactive position prior to initiating actuation of the drive motor 50 of the dunnage producing mechanism. In other words, the produced product is maintained stationary with respect to the mechanism during the cutting operation and shortly thereafter when the timer module 58 is in control of the activation of drive motor 50. A preferred form of on delay timer is one known as model TH 1A 410.7 S.S.A.C. Timer available from Jim Finnegan & Co. of Cleveland, Ohio.

When the workman initiates a severing or cutting operation by actuating the common cut button 48 and one or the other of the auxiliary cut buttons 42 or 44, and the dunnage producing mechanism is under the control of the automatic control circuit of the automatic timer module 58, the drive motor 50 will be deenergized. The severing operation by means of the cutter 34 will occur as aforedescribed while the produced dunnage product is stationary. Upon release of the selected cutter actuating cut buttons, the timer module 58 is delayed for approximately one second before it reenergizes drive motor 50 of the dunnage producing mechanism, thus giving the cutter apparatus 34 time to move from its active cutting or severing position back to its "home" or "inactive" position. Reset button 60 and associated latch relay (FIGS. 3 and 5) is provided for preventing inadvertent actuation of the converter drive motor 50 upon power reactivation thereof.

Anti-tie down and anti-repeat module 62 (FIG. 5) is provided in the control circuit for preventing immediate reenergization of the cutter mechanism 34 after completion of a cutting operation, and also preventing energization of the cutter mechanism if a machine operator attempts to by-pass the plural cutter button switch requirement by having some device mechanically hold one of the cutter button switches (e.g. common cutter switch 48) in its activated condition. For instance, if an operator would force a nail or wood splinter into any of the cutter button switches to hold it in activated condition, module 62 would prevent energization of the cutter solenoid **34*b* and thus prevent energization of the cutter mechanism 34. The main cutter button switch 48 and one or other of the auxiliary cutter button switches thus have to be actuated within a couple of seconds of one another or else the air solenoid 34*b* is inoperable. Likewise, both cutter button switches have to be released before the solenoid can be actuated to initiate a subsequent cutting operation. Anti-tie-down - anti-repeat module 62** is a commercially available item obtainable from Nolatron, Inc. of Harrisburg, Pa., and a suitable one has been found to be a module identified as No. 3370.

For example, if a machine operator wishes to program the dunnage producing mechanism 10 for producing cushioning dunnage product for say approximately ten minutes of time, he will set the range selector **58*a* on module 58 at the time range of ten minutes, and he will then move the timer control knob 58*b* to ten on the knob scale. He then will actuate to "on" the switch 36 whereby the electric motor 50 on the mechanism 10 will be energized after the aforediscussed one second delay to automatically cause production of the pad-like dunnage product for a period of approximately ten minutes. If the operator sets the control knob 58*b* on say for instance five on the scale instead of on ten, the production of the dunnage product will occur for half the selected range period or in other words for approximately five minutes (minus the one second delay). It will be seen therefore that the machine operator can select the range of time period for which he wishes the converter mechanism to automatically produce the pad-like dunnage product, and without any further monitoring or control or overseeing of the machine. The dunnage product is automatically produced for the selected period of time and then the drive motor 50 is automatically deactivated to await the next programmed instructions by the machine operator. Or on the other hand, the machine operator can manually operate the converter mechanism by means for instance of the foot switch 52, and which will necessitate continual activation of the foot switch until such time as the desired length of strip of pad-like dunnage product is produced by the mechanism, whereupon release of the pressure on the foot switch will automatically shut down the drive motor 50**.

From the foregoing discussion and accompanying drawings, it will be seen that the invention provides a dunnage converter mechanism for producing relatively low density pad-like cushioning dunnage product from flexible sheet-like stock material, and which mechanism includes a control circuit having a settable control means for selectively providing for programming the electric drive motor of the mechanism for automatic actuation thereof during a selected one period of time of a predetermined plurality of periods of time, whereby the pad-like dunnage product is automatically produced by the converter mechanism for the selected one time period without any further action required on the part of a machine operator.

The invention also provides a mechanism of the latter type which includes cutter means for selective severing of the produced dunnage product into selected lengths, together with means for automatically interrupting actuation of the drive motor of the converter mechanism upon actuation of the cutter means, whereby the cutting operation on the dunnage product occurs when the motor is deactivated and thus the dunnage product is stationary relative to the converter mechanism.

The terms and expressions which have been used are used as terms of description and not limitation, and there is no intention in the use of such terms and expressions of excluding any equivalents of any of the features shown or described, or portions thereof, and it is recognized that various modifications are possible within the scope of the invention claimed.

I claim:

1. In a mechanism for producing relatively low density pad-like cushioning dunnage product in strip form from flexible sheet-like stock material comprising a support frame, means on said support frame for pulling sheet-like stock material from a supply roll thereof into said mechanism and causing inward rolling of the lateral edges of the sheet-like stock material to form a pad-like product having lateral relatively resilient pillow-like sections and a central connecting section holding the pillow-like sections together in generally side-by-side relation and running generally lengthwise of the product, said means being also operable to emit the produced pad-like product from said mechanism, said means including an electric motor and settable control means operatively coupled to said motor and providing for selectively programming said motor for actuation thereof for a selected one period of time of a predetermined plurality of periods of time, whereby the pad-like product can be automatically produced by said mechanism for said selected one period without any further action on the part of a machine operator.

2. A mechanism in accordance with claim 1 including powered cutter means for selective cutting of the produced dunnage product into selected lengths, manual control means for causing actuation of said cutter means to institute said cutting operation, and means automatically interrupting actuation of said motor upon activation of said manual control means whereby said cutting operation on the dunnage product occurs when said motor is deactivated and thus the dunnage product is stationary relative to said mechanism.

3. A mechanism in accordance with claim 2 wherein said motor is a reversible motor and including manual control means for causing reverse actuation of said motor whereby the stock product produced in said mechanism is movable relative to said mechanism in the direction of the supply roll.

4. A mechanism in accordance with claim 1 wherein said plurality of periods of time of said settable control means includes seconds, minutes and hours, and means for selecting ranges of said selected one period of time.

5. A mechanism in accordance with claim 2 wherein said settable control means includes means for delaying reenergization of said motor for a predetermined period of time after a cutting operation in order to give said cutter means adequate time to return to its home position prior to initiating actuation of said motor.

6. A mechanism in accordance with claim 1 wherein the first mentioned means includes a pair of generally vertically oriented rotatable meshed gear-like members adapted for powered rotation about generally horizontally oriented axes, the stock material being adapted to be received between the bite of said gear-like members for accomplishing said pulling of said stock material into said mechanism and for forming said central connecting section on the produced product.

7. A mechanism in accordance with claim 1 wherein the stock roll comprises a multi-ply roll of superimposed sheets, and including separating means on said support frame upstream from the first mentioned means for separating the sheets of stock material as the latter move from the stock roll toward said first mentioned means.

8. A mechanism in accordance with claim 7 wherein said separating means comprises elongated transversely extending generally vertically spaced bar-like members about which a respective sheet of the stock material is adapted to pass in generally sliding relationship.

9. A mechanism in accordance with claim 7 wherein said first mentioned means includes a forming frame disposed downstream from said separating means, said forming frame being adapted to slidingly engage with and to press against the sheet-like stock material as it travels from the stock roll into said mechanism.

10. A mechanism in accordance with claim 1 wherein said means for causing inward rolling of the lateral edges of the sheet-like stock material includes a longitudinally converging funnel including a widened entrance end and a relatively narrower exit end.

11. In a mechanism for producing relatively low density pad-like cushioning dunnage product in strip form from flexible sheet-like stock material such as paper, comprising a support frame, means on said support frame for pulling sheet-like stock material from a supply roll thereof into said mechanism and causing inward rolling of the lateral edges of the sheet-like stock material to form a pad-like product having lateral relatively resilient pillow-like sections and a central connecting section holding the pillow-like sections together in generally side-by-side relation and running generally lengthwise of the product, said means being also operable to emit the produced pad-like product from said mechanism, said means including an electric motor for powering said mechanism, and a control circuit for controlling operation of said motor, said circuit including a settable control module providing for selectively programming said motor for actuation thereof for a selected one period of time of a plurality of periods of time, whereby the pad-like product can be automatically produced by said mechanism for said selected one period without any further required action on the part of a machine operator, said control circuit including manual control means operative to deactivate said control module and provide for manually controlling operation of said motor.

12. A mechanism in accordance with claim 11 including powered cutter means on said frame for selective severing of the produced dunnage product into selected lengths, said cutter means being movable from an inactive position to an active cutting position and return to said inactive position, said circuit including control means for controlling the actuation of said cutter means, the last mentioned control means including manual switch means for instituting actuation of said cutter means, said manual switch means including means which upon actuation of said switch means automatically interrupts actuation of said motor whereby the severing operation on the dunnage product can occur only when said motor is deactivated and thus the dunnage product is stationary relative to said frame.

13. A mechanism in accordance with claim 12 wherein said plurality of periods of time of said control module includes seconds, minutes and hours, and including means for selecting ranges of each said selected one period of time.

14. A mechanism in accordance with claim 13 including timer means coacting with said control module providing for delaying reenergization of said motor for a predetermined time period after said severing operation in order to give said cutter means adequate time to return to its inactive position prior to initiating actuation of said motor.

* * * * *